US007325607B2

(12) United States Patent
Massingill et al.

(10) Patent No.: US 7,325,607 B2
(45) Date of Patent: Feb. 5, 2008

(54) METHODS AND SYSTEMS FOR USING HIGH-YIELDING NON-NEWTONIAN FLUIDS FOR SEVERE LOST CIRCULATION PREVENTION

(75) Inventors: Robert Massingill, Porter, TX (US); Melissa Allin, Comanche, OK (US); Rickey Morgan, Duncan, OK (US); Mark Savery, Duncan, OK (US); Ron Morgan, Waurika, OK (US); Johnny Johnson, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 183 days.

(21) Appl. No.: 11/175,977

(22) Filed: Jul. 6, 2005

(65) Prior Publication Data

US 2007/0007006 A1 Jan. 11, 2007

(51) Int. Cl.
*E21B 47/00* (2006.01)
*E21B 21/08* (2006.01)
*E21B 44/00* (2006.01)

(52) U.S. Cl. ..... 166/252.5; 166/53; 175/40; 175/72; 702/9; 703/10

(58) Field of Classification Search ..... None
See application file for complete search history.

(56) References Cited

U.S. PATENT DOCUMENTS 4,346,594 A * 8/1982 Owings ..... 73/152.19
6,668,943 B1 * 12/2003 Maus et al. ..... 175/5

OTHER PUBLICATIONS

Foreign communication related to a counterpart application dated Sep. 4, 2006.
XP-002395521 "Specific Mixing Energy: A Key Factor for Cement Slurry Quality" by D.J. Orban, et al. SPE15578 dated Oct. 5, 1986.
XP-008067970 "Experimental Mixing Energy Evaluation of Foam Cements Within Laboratory Blenders" by Curtis M. Vickery dated Feb. 14, 2000.
XP-002395522 "Shear Rate has Greater Influence on Cement Slurry Properties than Total Mixing Energy" by Paul Padgett dated Oct. 7, 1996.

* cited by examiner

*Primary Examiner*—Zakiya W. Bates
(74) *Attorney, Agent, or Firm*—John W. Wustenberg; Groover & Associates

(57) ABSTRACT

A system and method to model and analyze the mixing energies of high-yielding non-Newtonian fluids to prevent chemical lost circulation. Laboratory tests are performed under varying conditions from which data on the mixing energies needed to optimize the use of high-yielding non-Newtonian fluids to prevent lost circulation is obtained. This data is then applied to a non-linear mathematical modeling system that is capable of scaling the data to give a dimensionless value. This value can be combined with historic information to predict optimal flow rates and mixtures to prevent chemical lost circulation. This data may be verified by means of simulation, lab testing, or application to a full-size well.

25 Claims, 10 Drawing Sheets

| Mud Type | p | Alpha | Beta |
|---|---|---|---|
| Internal Olefin/Ester Blend | 1 | 0.000105 | 1 |
| Internal Olefin | 1.11 | 0.00005 | 1.5 |
| Diesel-Based | 0.95 | 0.00002 | 0.3 |

METHODS AND SYSTEMS FOR USING HIGH-YIELDING NON-NEWTONIAN FLUIDS FOR SEVERE LOST CIRCULATION PREVENTION

FIELD OF THE INVENTION

The present invention relates generally to the control and modeling of mixing energy, and more specifically to the optimizing of chemical lost circulation treatment analysis and modeling of energies and macromolecular interactions.

BACKGROUND AND SUMMARY OF THE INVENTION

During the drilling phase of an oil or gas well, it is necessary to ensure the wellbore pressure integrity is maintained at all times. This necessity arises because it is customary to provide a well drilling fluid that is passed downward through the drill string and upward external to the drill string in order to cool and lubricate the drill bit, as well as carry away the cuttings produced by the drill bit. The drilling fluid, also known as mud, maintains hydrostatic pressure on the subterranean zones through which the wellbore is drilled and circulates cuttings out of the wellbore. It also, under ideal conditions, creates an impermeable filter cake along the walls of the wellbore that prevents loss of the drilling fluid, maintains wellbore wall integrity (i.e. prevents cave-ins), and minimizes formation damage due to drilling fluid invasion. Subterranean vugs, fractures and other thief zones are often encountered during drilling whereby the drilling fluid circulation is lost, and drilling operations must be terminated while remedial steps are taken.

In addition to underground blowouts, cross flow, and loss of hydrostatic pressure, lost circulation can lead to a drill pipe becoming lodged in the wellbore. Some formations are very porous, so that a considerable flow of drilling fluid can be forced into the rock. (Some "vuggy" formations may even contain natural cavities.) In extreme circumstances, from tens to hundreds of barrels of drilling fluid can be forced into the rock, which can often cause permanent fractures. In these extreme cases and in other severe situations involving vugs, fractures, formation cavities and the like, placing a high yield point material similar to the consistency of window caulking is a viable option to plug off the zone. Although commercial products like this exist, a method to accurately predict the mixing energy required to optimize these products was not previously identified prior to the present invention. See Gockel, J. F., et al., "*Lost Circulation: A Solution Based on the Problem*", presented at 1987 Society of Petroleum Engineers/International Association of Drilling Contractors (SPE/IADC) Drilling Conference, New Orleans, La., Mar. 15-18, 1987. (SPE Paper No. 16082) Canson, B. E., "*Lost Circulation: Treatments for Naturally Fractured, Vugular or Cavernous Formations*", presented at the SPE/IADC 1985 Drilling Conference, New Orleans, La., Mar. 6-8, 1985. Sanders, W. W., "*Lost Circulation: Assessment and Planning Program: Evolving Strategy to Control Severe Losses in Deepwater Projects*", presented at the SPE/IADC Drilling Conference, Amsterdam, The Netherlands, Feb. 19-21, 2003. (SPE paper No. 79836).

While a variety of compositions have been developed and used for combating lost circulation, cross flows and underground blowout problems, such compositions have often been unsuccessful due to delayed and inadequate viscosity development by the compositions. An appreciable yield point and a significant level of viscosity, or the degree to which a fluid resists flow under an applied force, is needed in order for the compositions to combat the aforementioned lost circulation. For example, a variety of cement compositions have been used in attempts to stop lost circulation. The lost circulation is usually the result of encountering weak subterranean zones that contain natural fractures or are fractured by drilling fluid pressures and rapidly break down. U.S. Pat. No. 1,807,082 issued May 26, 1931, to Boynton discusses the introduction of mica flakes into the well fluid circulation for coating the wall of the wellbore. U.S. Pat. No. 2,342,588 issued Feb. 22, 1944, to Larkin discloses the method of mixing a quantity of small pieces of sponge rubber with the well drilling fluid. The sponge rubber particles are deposited in the cracks and fissures and thereafter expand to fill them. U.S. Pat. No. 2,353,372 issued Jul. 11, 1944, to Stone discloses the mixing of fragmented organic grain less foil with the well drilling fluid for circulation therewith and disposition within the cracks and fissures of the wellbore walls for reducing the lost circulation of the well drilling fluid. U.S. Pat. No. 2,634,236 issued Jul. 14, 1953 to Fisher discloses the admixing of fiberized leather with the drilling fluid. U.S. Pat. No. 3,221,825 issued Dec. 7, 1965, to Henderson discloses the mixing of cork particles with the well drilling fluid for sealing off the cracks and fissures of the wellbore walls. U.S. Pat. No. 3,254,064 issued May 31, 1966, to Nevins discloses the use of solid, stretchable, deformable organic polymers in the well drilling fluid for blocking off leaks in the wellbore walls. U.S. Pat. No. 3,568,782 issued Mar. 9, 1971, to Cox discloses the use of popcorn in the well drilling fluid. U.S. Pat. No. 3,788,405 issued Jan. 29, 1974, to Taylor discloses the use of a mixture of straw and chemical wood pulp fibers for blocking off the lost circulation in the wellbore. U.S. Pat. No. 4,222,444 issued Sep. 16, 1980, to Hamilton discloses using magnetic material, such as discarded magnetic tape, to block the unwanted loss of fluid in a wellbore. U.S. Pat. No. 6,060,434 issued on May 9, 2000, discloses using oil-based compositions for sealing subterranean zones. U.S. Pat. No. 6,258,757 issued on Jul. 10, 2001 to Sweatman discloses using water based compositions for sealing subterranean zones. All of the above are hereby incorporated by reference.

Solutions, such as the ones found in the U.S. Pat. Nos. 6,060,434 and 6,258,757, often use two streams of materials to combat lost circulation problems. For example, drilling mud and reactant FlexPlug®, commercially available from Halliburton, can be used downhole to form a highly viscous paste-type material with the consistency of window caulking. It has been found in the present invention that the ability of FlexPlug® to withstand wellbore pressures and combat lost circulation depends upon the chemical formulation of the reactants, the mass ratio of wellbore fluids to product slurry(s), and the degree of mixing. The degree of mixing can be generally quantified in terms of mixing energy (such as Joules/Kg, etc.). An increase in the mixing energy usually yields a higher quality product.

There are different chemical recipes that can be used as downhole reactants. The term "chemical recipe" is generally used to refer to the contents of the chemical treatment. Therefore, the chemical recipe is the mix of chemicals that the designer uses to combat lost circulation.

The chemical recipe may be water or oil based. In a water based chemical recipe, the compositions and methods are particularly suitable for sealing subterranean zones containing oil based drilling fluids, e.g., water in oil emulsions, known as inverted emulsions. The compositions are basically comprised of water, an aqueous rubber latex, an organophilic clay, and sodium carbonate. The compositions can also include one or more latex stabilizers, dispersing agents, biopolymers, defoaming agents, foaming agents, emulsion breakers, fillers, rubber vulcanizing agents and the like.

The second type of chemical recipe is the oil-based recipe. The compositions are basically comprised of oil, a hydra table polymer, an organophilic clay, and a water swellable clay. The compositions can also include cross-linking agents, dispersing agents, cement, fillers and the like. When the sealing compositions of this chemical recipe contact water in the wellbore, the hydra table polymer reacts with the water whereby it is hydrated and forms a highly viscous gel, and the water swellable clay swells whereby an ultra high viscosity mass is formed.

These chemical recipes are generally delivered to a downhole wellbore as one stream, mixing with a second or more streams of wellbore fluids at the desired downhole location. The composition and mixing of the recipe with the wellbore fluids dictate the quality of the product of the mixture. For a dual stream reaction between FlexPlug® and drilling mud, it has been found that the preferred volumetric ratio is 1:1 for most drilling muds encountered, but is not limited to 1:1 ratio.

Historically, the rate at which these reactive products have been pumped and placed has been based on rules of thumb or surface equipment limitations, but no consideration has been taken for the effect of this rate on the quality of the final product. This lack of consideration of mixing energy during the placement of a multi-stream reactive product has been the result of the lack of accurate modeling and scaling techniques of the mixing phenomena (energies and macromolecular interactions) of multi-stream chemical treatments, resulting in the lack of empirical data to prove the importance of mixing energy. There is no current technology that can provide accurate guidance to the proper design of multi-stream chemical treatments. No models or systems have been capable of taking the myriad of variables present in downhole conditions and combine them in a way to accurately predict the required mixing energy for a chemical recipe. The result of this problem is sometimes a failure to cure the loss zone, which may have been avoided had a procedure backed by recommendations from modeling been available.

There are several categories of variables that can be adjusted at the drill site. First, the materials, chemicals, and design of the drill string may be adjusted to particular well conditions. Second, the flow rate and pressure of the substances being pumped into the wellbore may be adjusted. The present invention suggests a way to optimize the mixing energy of a multi-stream treatment by manipulating the variables mentioned above. This is in part because the mixing phenomenon (energies and macromolecular interactions) of chemical treatments have never been accurately modeled or scaled.

Background: Buckingham Pi Theorem

The Buckingham theorem states that the functional dependence between a certain number of variables (e.g., n) can be reduced by the number of independent dimensions (e.g., k) occurring in those variables to give a set of (n−k) independent, dimensionless numbers. Essentially, this theorem describes how every physically meaningful equation involving n variables can be equivalently rewritten as an equation of n−k dimensionless parameters, wherein k is the number of fundamental units used.

This theory only provides a way of generating sets of dimensionless parameters and will not choose the most 'physically meaningful'. See Buckingham, E., "On Physically Similar Systems; Illustrations of the Use of Dimensional Equations" *Phys. Rev.* 4, 345-376 (1914); Buckingham, E. "The Principle of Similitude", *Nature* 96, 396-397 (1915); Buckingham, E., "Model Experiments and the Forms of Empirical Equations". *Trans. A.S.M.E.* 37, 263-296 (1915); Görtler, H., "Zur Geschichte des pi-Theorems", (On the history of the pi theorem, in German.), *ZAMM* 55, 3-8 (1975); Curtis, W. D., Logan, J. D., Parker, W. A. "Dimensional Analysis and the Pi Theorem", *Lin. Alg. Appl.* 47, 117-126 (1982).

Mixing Energy Analysis of Non-Newtonian Fluids

In a preferred embodiment, the present application discloses systems and methods for optimizing systems which utilize the convergence and mixing of multiple fluid streams to form a high-yielding non-Newtonian viscous fluid that is capable of resisting pressure, and systems and methods for determining the required mixing energy of materials. This is accomplished in this preferred embodiment by collecting a limited number of benchtop-sample test data in combination with a proprietary dimensionless mixing number, having been derived by similitude analysis, which allows the benchtop data to be extrapolated to the actual wellbore.

One of the innovative features of one of the preferred embodiments of this application is the modeling of downhole mixing energy of different materials through the use of dimensionless analysis. For example, this new approach to modeling downhole-mixing energy enables measurement of the mixing energy required at a smaller scale, referred to as a benchtop scale, in order to form acceptable reacted products consisting of the mixture of multiple streams of products in downhole situations.

Another innovative feature of these innovations is the ability to apply these predictive model sets based on extrapolated data to varying downhole parameters. This innovation allows for the accurate prediction of the mixing energy required for different material compositions, under varied types of geological conditions, and when using varied types of equipment (i.e. pumps, drill bits, tubulars, jet sizes, or even thief zone geometric parameters).

Yet more innovative features of the disclosed inventions are methods and apparatus used to obtain specialized quantitative measurements with a limited number of samples and correlate this with the aforementioned innovative predictive models.

Yet another innovative feature of the disclosed inventions is the method and apparatus used to combine the innovative method of modeling downhole conditions with a dimensionless variable that can be used to accurately predict the mixing energy required to form an acceptable product made by the combination of the multiple fluid streams. This dimensionless variable can be used to extrapolate acceptable flow rates and preferred equipment to be used in drilling operations.

Other innovative features are described below.

It should, of course, be understood that the description is merely illustrative and that various modifications and changes can be made in the structure disclosed without departing from the spirit of the invention.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figures 1, 2:
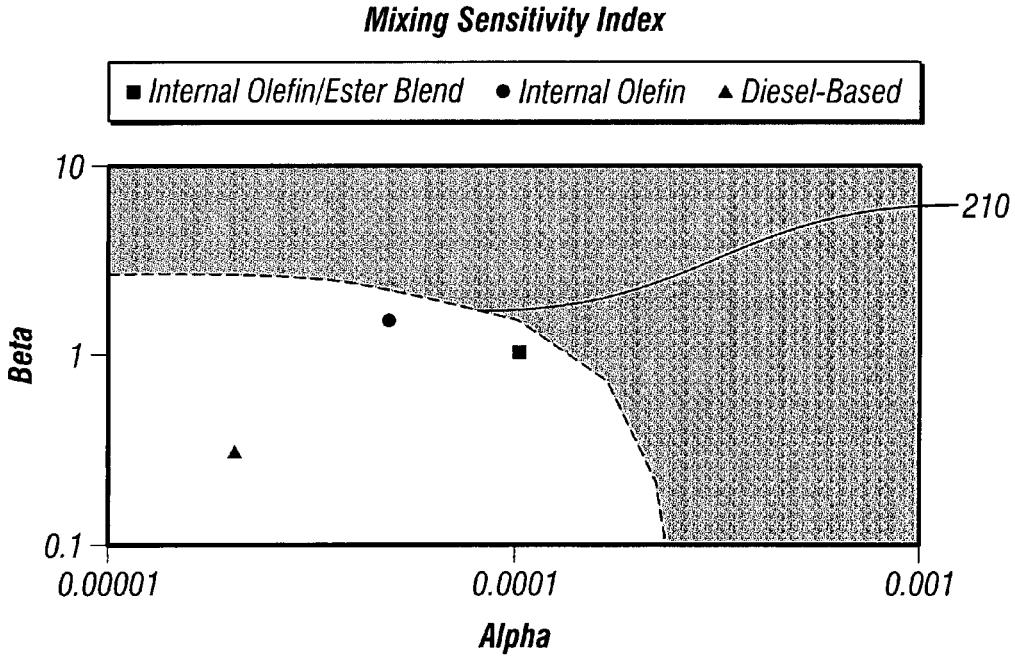
FIG. 1 shows a table of data regarding the optimal parameters for different drilling mud compositions in the generalized rheological model.
FIG. 2 shows a graph of data created from FIG. 1.

The numerous innovative teachings of the present application will be described with particular reference to a presently preferred embodiment (by way of example, and not of limitation).

One of the innovations disclosed in this application is the ability to model the range of mixing energies required by high-yielding non-Newtonian or similar fluids to prevent lost circulation in downhole conditions. In one example embodiment of the present inventions, a mathematical methodology, such as similitude, is used to scale, design, and optimize the mixing energy transferred to a chemical treatment reaction that occurs in-situ at the desired location downhole. This mixing energy can be controlled, in this example, by the flow rates of the various fluid streams that combined to make the reacted product, hardware design choices (i.e. drill bit jet diameters, tubulars, etc.), wellbore geometry, thief zone geometry and nature, and other factors known by someone skilled in the art, or any combination of the previous items.

Though the example embodiments used to describe the present innovations are given in the context of oil well drilling and repair, the present innovations are applicable to a wide array of other applications. For example, the present innovations can be used more generally in any circumstance where an unknown amount of mixing energy is needed for different substances to combine and form a product with desirable properties.

In one embodiment, the shear rate, or shear stress at a point proportional to the rate of strain, is determined through a set of tests designed to be conducted at a drill site prior to scaling, designing, and optimizing a multi-stream chemical treatment. In other embodiments, this innovative step may be substituted by using a set of known parameters rendering this testing and determination of shear rate unnecessary.

In one embodiment, the testing apparatus may use a spinning "blender" to determine shear rate of the product of a given composition. One of the innovations disclosed within this application is the relationship between this shear rate and a constant that is dependant upon the velocity of the "blender". This relationship may be defined as the following:

$$\dot{\gamma}=K_1(\mathrm{RPM}) \tag{1}$$

In this example, $\dot{\gamma}$ is the shear rate, K is the constant for the apparatus being used to measure the shear rate, and the RPM is equivalent to the rotation of the blender blade. It should be understood that K is a function of the parameters within the blending including, but not limited to, diameter, material coefficient, and other appropriate factors. There are many different ways in which the shear rate can be calculated, and these inventions are not limited to this embodiment.

One of the innovations disclosed in utilizing this shear rate is the use of the integral shear history (ISH) as a reference to determine the optimum yield point. The ISH is defined as follows:

$$ISH = \int_{t_o}^{t} \dot{\gamma}^p dt = (t - t_o) = t_{mix}\dot{\gamma}^p \tag{2}$$

In this equation, $\dot{\gamma}$ is the shear rate, $_p$ is a constant based upon the material sensitivity to shear, and t relates to time.

A generalized rheological equation derived from a first order relationship is used to find the correspondence from the point at which a sufficient amount of mixing energy is present to obtain an acceptable product from the resultant reacted product, or yield point, to the ISH. The following equation was found to be an accurate relationship between the elements:

$$YP(ISH)=YP_0+(YP_\infty-YP_0)(1-e^{-\alpha(ISH)})^\beta \tag{3}$$

In this equation, $YP_0$ is the initial yield point, $YP_\infty$ is the final yield point, $_\alpha$ is the pseudo rate constant, and $_\beta$ is the material rate constant.

FIG. 1 represents a table that was created to show the relationship between different types of mud and their corresponding p, alpha, and beta values. This table was used to create the graph shown in FIG. 2.

FIG. 2, which illustrates the optimal range in which these values should be chosen. This graph also illustrates a verification line 210 that is derived from equation (3) under which acceptable yields are obtained.

It has further been found that a "mixing sensitivity index" such as FIG. 2 can be used to verify that the result found from equation (3) is accurate.

Another innovation disclosed by this application discloses how this relationship is applied. There are several variables that characterize multi-stream mixing.

Utilizing these variables in conjunction with the Buckingham Pi theorem, the number of quantities may be reduced by the number of dimensions yielding a set number of dimensionless terms. The generalized product solution of the theorem may be expressed as:

$$\pi_1=f(\pi_2\pi_3\pi_4\ldots)=A(\pi_2)^{B_1}(\pi_3)^{B_2}(\pi_4)^{B_3} \tag{4}$$

In one example, the process of using the similitude model in conjunction with mixing energy laboratory experiments is used to give a relationship between the quality of the product and mixing energy (i.e. kinetic energy in terms of velocity out of the drillbit) from which best practices and other recommendations can be made. One of the relationships that was derived that gives this type of analysis is:

$$PI_{mix} = \frac{\rho_{FP} V_{FP}^2}{2\tau_{oFP}} \tag{6}$$

In this equation $V_{FP}^2$ is the velocity of the FlexPlug® slurry, $\rho_{FP}$ is the density of the slurry, and $\tau_0$ is the shear stress on the slurry.

The following is a representative list of nondimensionalized parameters used in the similitude model.

$$\frac{\rho_M V_M (D_W - D_B)}{\mu_{\infty M}} \rightarrow \text{Reynolds Number for Mud}$$

$$\frac{D_N}{D_W} \rightarrow \text{Ratio of Nozzle Diameter to Wellbore Diameter}$$

$$\frac{\rho_{FP} V_{FP} D_N}{\mu_{\infty FP}} \rightarrow \text{Reynolds Number for } FlewPlugOBM®$$

$$\frac{D_B}{D_W} \rightarrow \text{Ratio of Drill Bit Diameter to Wellbore Diameter}$$

$$\frac{\rho_M \tau_{oM} D_W^2}{\mu_{\infty M}^2} \rightarrow \text{Hedstrom Number for Mud}$$

$$\frac{\tau_{oM}}{\tau_{oFP}} \rightarrow \text{Ratio of Mud Yield Point to } FlexPlugOBM® YieldP$$

$$\frac{\rho_{FP} \tau_{oFP} D_N^2}{\mu_{\infty FP}^2} \rightarrow \text{Hedstrom Number for } FlexPlugOBM®$$

$$\frac{\rho_M}{\rho_{FP}} \rightarrow \text{Ratio of Mud Density to } FlexPlugOBM® \text{Density}$$

$$PI_{mix} = \frac{\rho_{FP} V_{FP}^2}{2\tau_{oFP}} \rightarrow PIMixingNumber$$

In these equations, the V terms are the velocities of the multi-streams, the ρ terms are the densities of the multi-streams, the $\tau_o$ are the shear stresses on multi-streams, and the D terms relate to the diameters of the wellbore and drill bit geometries.

This mixing number ($PI_{mix}$) can be used to determine the relationship of ISH to flow rate (Note: flow rate is a function of $V_{FP}^2$ and density of FlexPlug®) of either, or both, the wellbore fluids or product slurry(s) in a given well that will stimulate the desired product.

This innovation may be applied to a number of different situations where the downhole mixing energy plays a role in the formation of viscous materials. Two common embodiments are when predominant amounts of water or aqueous fluid are located in the wellbore and predominant amounts of oil or non-aqueous fluid are found in the wellbore. One of the innovations of the present inventions is the ability to optimize the energy for any chemical recipe that will be used, and is applicable beyond oil well drilling.

In one embodiment, an innovative advantage of the present inventions is the ability to use benchtop laboratory mechanical mixing equipment, with varying conditions such as RPM, mixing time, and shear rate, to simulate the in-situ downhole mixing process and predict the yield point of the final product. The ISH is sum of the different shear rates (γ) under varying locations and varying conditions including the length of time the shear is applied (Δt), and is calculated using the following equation:

$$ISH = \dot{\gamma}_{Bit}{}^{P} \Delta t_{Bit} + \dot{\gamma}_{Annulus}{}^{P} \Delta t_{Annulus} + \dot{\gamma}_{Thief}{}^{P} \Delta t_{Thief} + \gamma_{Screen}{}^{P} \Delta t_{Screen} \tag{7}$$

Figure 4:
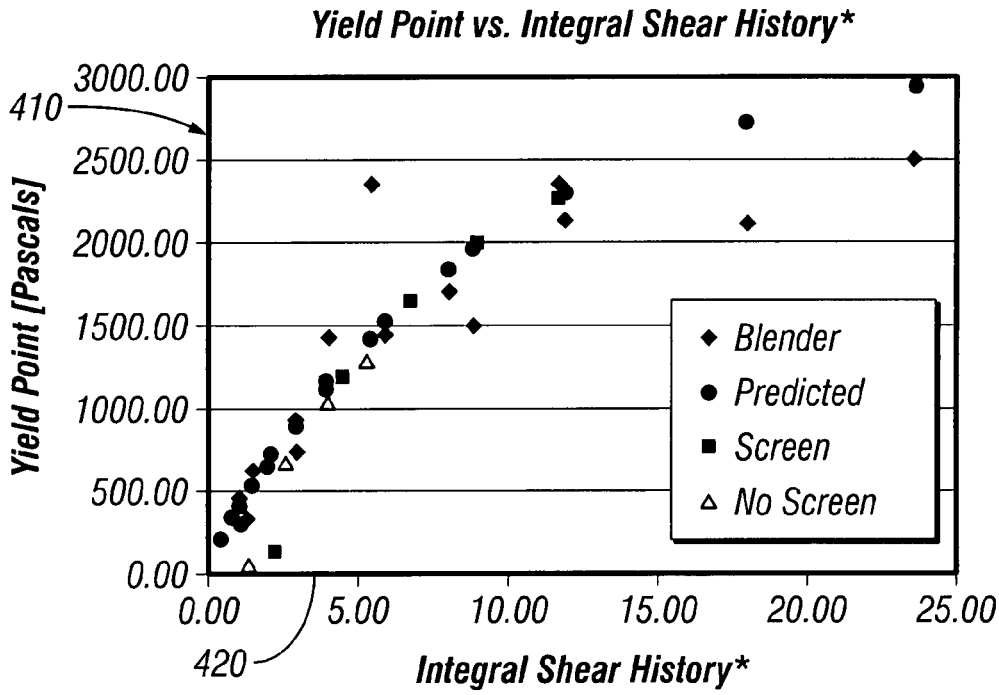
FIG. 4 shows a plot of the Integral Shear History (ISH) and the yield point of a high-yielding non-Newtonian product using the predicted model, the scaled model, and the empirical blender tests.

In one example embodiment, the present inventions can use the Integral Shear History (ISH) of the similitude modeling system coupled with bench top results to create data plots that represent what mixing energy is required to obtain acceptable yield of lost product material. FIG. 4 relates ISH to the product quality (yield point) results of the scaled apparatus, benchtop data, and predicted values. These coupled results yield a relationship between ISH to a Pi Mixing Number (PMN) that can accurately predict the window of optimal flow rate of the two stream system to ensure the best product possible. Hence, another important innovation presented herein has to do with the concept of using this proprietary "mapping function or model" to design and implement real time control during job execution. One example of a control that may be altered to stimulate the mixing energy is the altering of the flow rate of any given fluid stream along its flowpath to the location downhole where the multi-streams converge.

It should, of course, be understood that the description is merely illustrative and that various modifications and changes can be made in the structure disclosed without departing from the spirit of the invention.

In one embodiment, the disclosed inventions take advantage of a new way in which dimensionless analysis can be used to scale, design, and optimize a multi-stream chemical treatment that occurs in-situ at a desired location downhole. The present invention also takes advantage of a new way in which dimensionless analysis can be used to scale, design, and optimize any (i.e. not limited to just lost circulation applications) multi-stream system in which mixing energy is an integral part of achieving desired final properties of the reacted product.

In one preferred embodiment, a multiple step process is used to optimize the downhole conditions. First, a chemical recipe is selected for the particular well from drill logs and wellbore data. Second, bench top samples of a combination of product slurry and one or more representative wellbore fluids are prepared at four integral shear history (ISH) conditions by using different mixing speeds and times for a given sample volume and mixer. Third, a product master curve is built that correlates ISH, or the sum of the bench top tests, to Yield Point (YP), or quality of product in the bench top tests, for a given recipe. Finally, the flow rate and resultant YP will create a reacted product of sufficient strength to achieve job objectives.

In a preferred embodiment that implements the above method, a mathematical model based upon the pi theorem is created that is combined with empirical data (e.g., the bench top samples) to model a relationship between the quality of the product (yield point) and mixing energy (i.e., kinetic energy in terms of velocity of the drillbit, or ISH) from which best practices and other recommendations can be made. These best practices might include the choice of the bit and nozzles to be used, the control of the flow rate, the particular mixture of the lost product treatment, and other disclosed factors.

Figure 3:
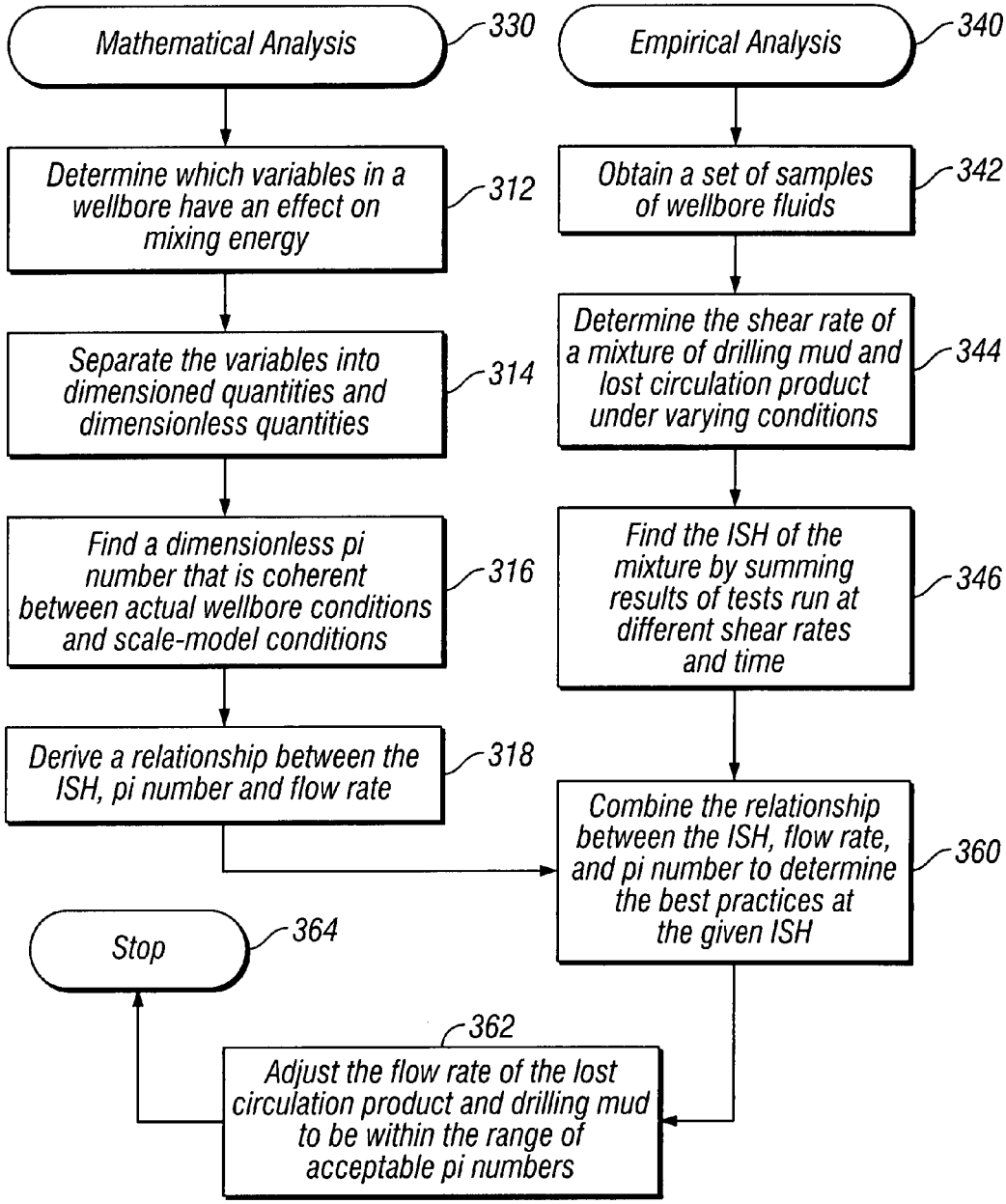
FIG. 3 shows a flowchart of the innovative modeling process that serves as an example consistent with a preferred embodiment.

FIG. 3 is an overview flowchart of one of the disclosed embodiments. In this example embodiment, the mathematical analysis is used to develop a model of the required mixing energy in downhole situations. First, the variables present in a wellbore that affect the downhole mixing energy are determined (step 312). These dimensioned variables are then separated into dimensionless categories and equations that accurately describe the way fluids behave on any scale, large or small (step 314). These equations are modified by the use of the chosen variables to take into account the physical nature of non-Newtonian fluids. The dimensionless quantities solvable through similitude to find a dimensionless pi number that is coherent between actual wellbore conditions and scaled-model conditions (step 316). From this pi number, a relationship is derived between ISH, pi number, and the flow rate (step 318).

In this example, the empirical analysis used either as a tool in the field to adjust the drilling parameters to maximize mixing energy or to validate the mathematical analysis is done in parallel with the mathematical analysis. The first step in the empirical analysis, in this example, is to obtain a set of samples of wellbore fluids (step 342). Next, the shear rate of the wellbore fluids and lost circulation product is determined at varying mixing energies by varying the time and speed at which the lost circulation product is combined with the wellbore fluids (step 344). A blender can be used for this analysis. These measurements are then used to determine the (ISH) (step 346) through a first order equation that predicts the point at which a sufficient amount of mixing energy is present to obtain an acceptable product.

This example combines the mathematical models predictions with the actual conditions determined by the empirical analysis to give the drilling operator the flow rate or other variables to obtain the best downhole product step (step 360). The operator can then adjust the flow rate of the fluid streams and, subsequently, the pi numbers so that the mixing energy is sufficient to form an acceptable product (step 362).

FIG. 4 shows a graph 400 of the Integral Shear History and yield point of the lost circulation product and wellbore fluids. Yield point 410 is plotted on the y-axis and Integral Shear History 420 is plotted on the x-axis. The modeling of the ISH against the product quality using one example embodiment allows for the study of product quality against downhole Integral Shear. The data shown in this chart is from a previously run test, and is for example purposes only.

Figure 5:
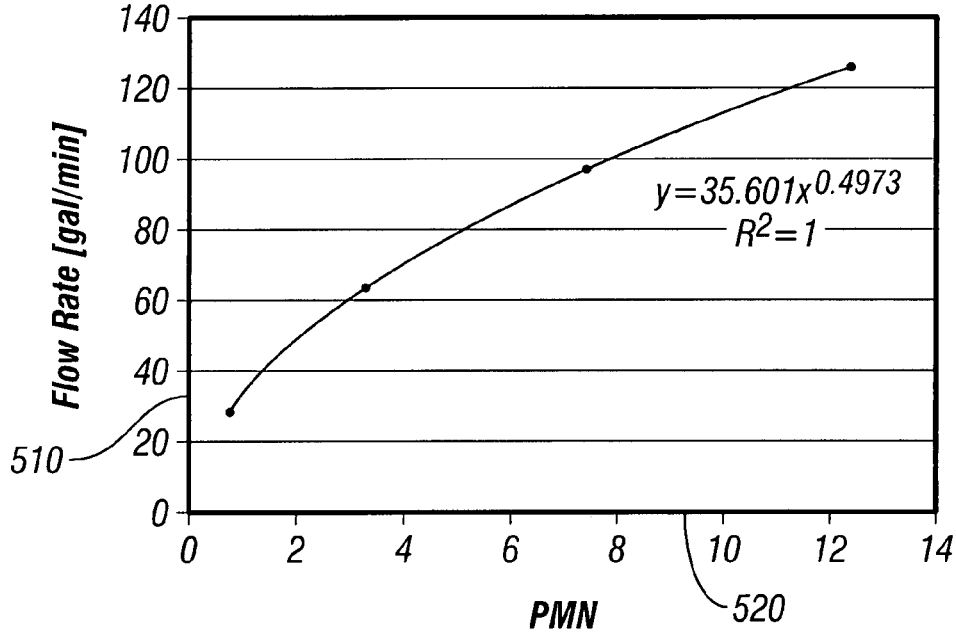
FIG. 5 shows a plot of the flow rate and Pi Mixing Number (PMN) acquired from one of the innovative models.

FIG. 5 shows a plot 500 of the Integral Shear History 510 compared to the pi mixing number 520 using a process substantially similar to similitude modeling. This chart can be used in some example embodiments to choose a flow rate once the PMN has been chosen.

Figure 6:
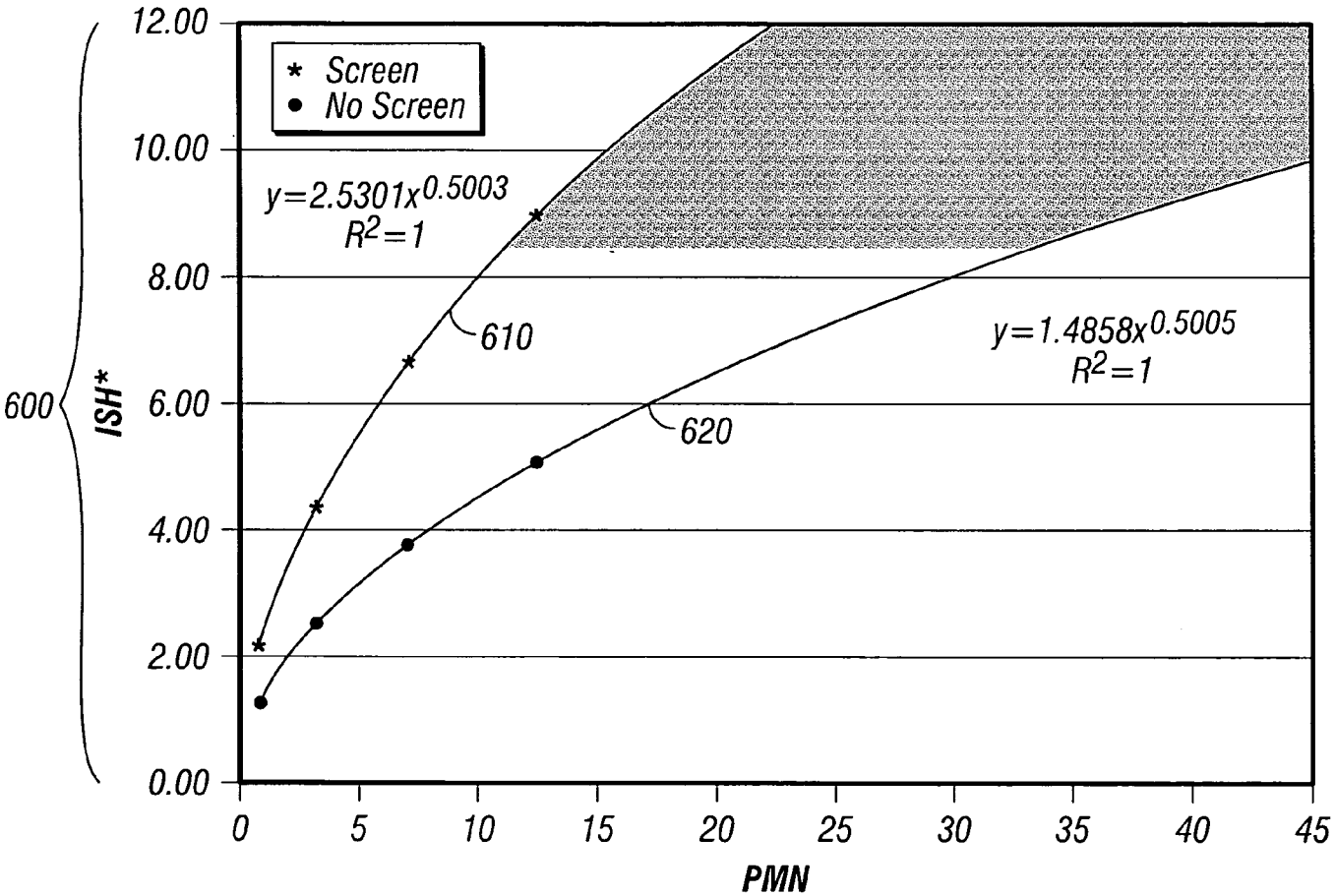
FIG. 6 shows the relationship of the ISH to the PMN and the range of acceptable combinations to form a sufficiently viscous product.

FIG. 6 shows a plot 600 of the ISH to the PMN. The shaded area on the graph is where an acceptable product is created. This graph also highlights the difference that equipment choices can make when determining the proper flow rates required to form an acceptable downhole product by showing the ISH correlation with and without a screen. Both the result of the use of a screen 610 and the absence of a screen 620 is shown. The no-screen situation assumes that the only shear that is introduced into to the system is due to jet mixing at the bit, whereas the screen situation assumes that other sources of shear (e.g. fracture entrance effects) are present down-hole. This essentially encompasses a best-case scenario (screen) and worst-case scenario (no screen). The chart's darkened area represents the point at which a mixture of wellbore fluids and lost circulation product slurry(s) with a particular PMN will have sufficient mixing energy to form a product of acceptable viscosity.

Figure 7:
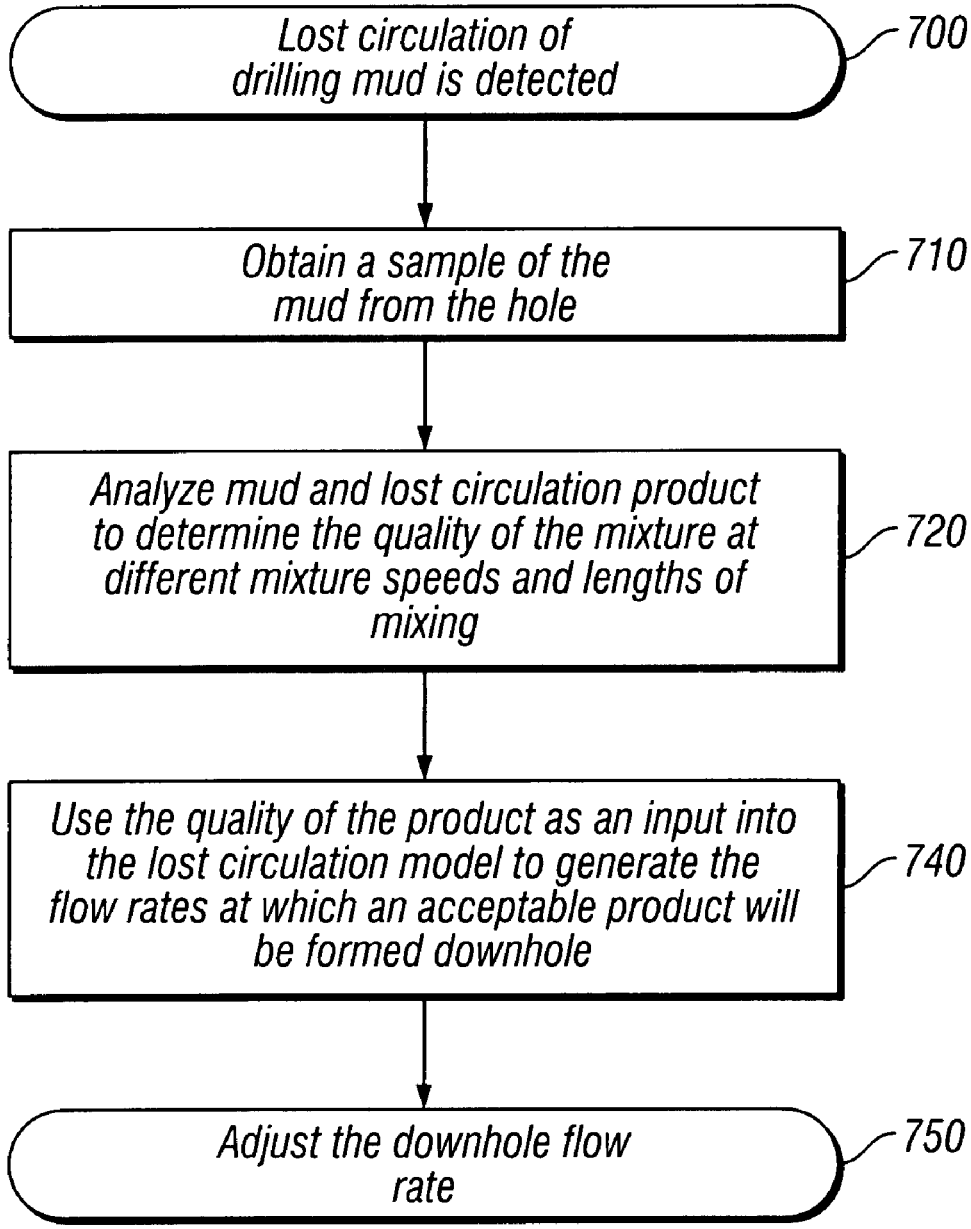
FIG. 7 shows a flowchart of a preferred embodiment.

FIG. 7 shows a flowchart of a preferred embodiment of one of the present inventions. This process is started when (step 700) lost circulation of drilling mud is detected, likely by a detected loss of pressure or amount of mud returning to the surface. After the lost circulation is detected, the operator will need to (step 710) obtain a sample of the wellbore fluids. This sample is necessary because the composition of wellbore fluids varies from wellbore to wellbore, and in order to determine the interaction of the fluids of a given wellbore with the lost circulation product slurry(s), bench top testing needs to be conducted. The next step is to (step 720) analyze wellbore fluids and lost circulation product slurry(s) to determine the quality of the mixture at different mixture speeds and lengths of mixing. This step is preferably done by blending a combination of wellbore fluids and lost circulation product slurry(s) at known speeds for predetermined amounts of time. After this analysis is completed, (step 740) the operator will use the quality of the product as determined in the previous analysis as an input into the lost circulation model that has been disclosed as the relationship between the shear rate and mixing energy to generate the flow rates at which an acceptable product will be formed downhole. The final step (step 750) is for the operator to adjust the downhole flow rate.

Figure 8:
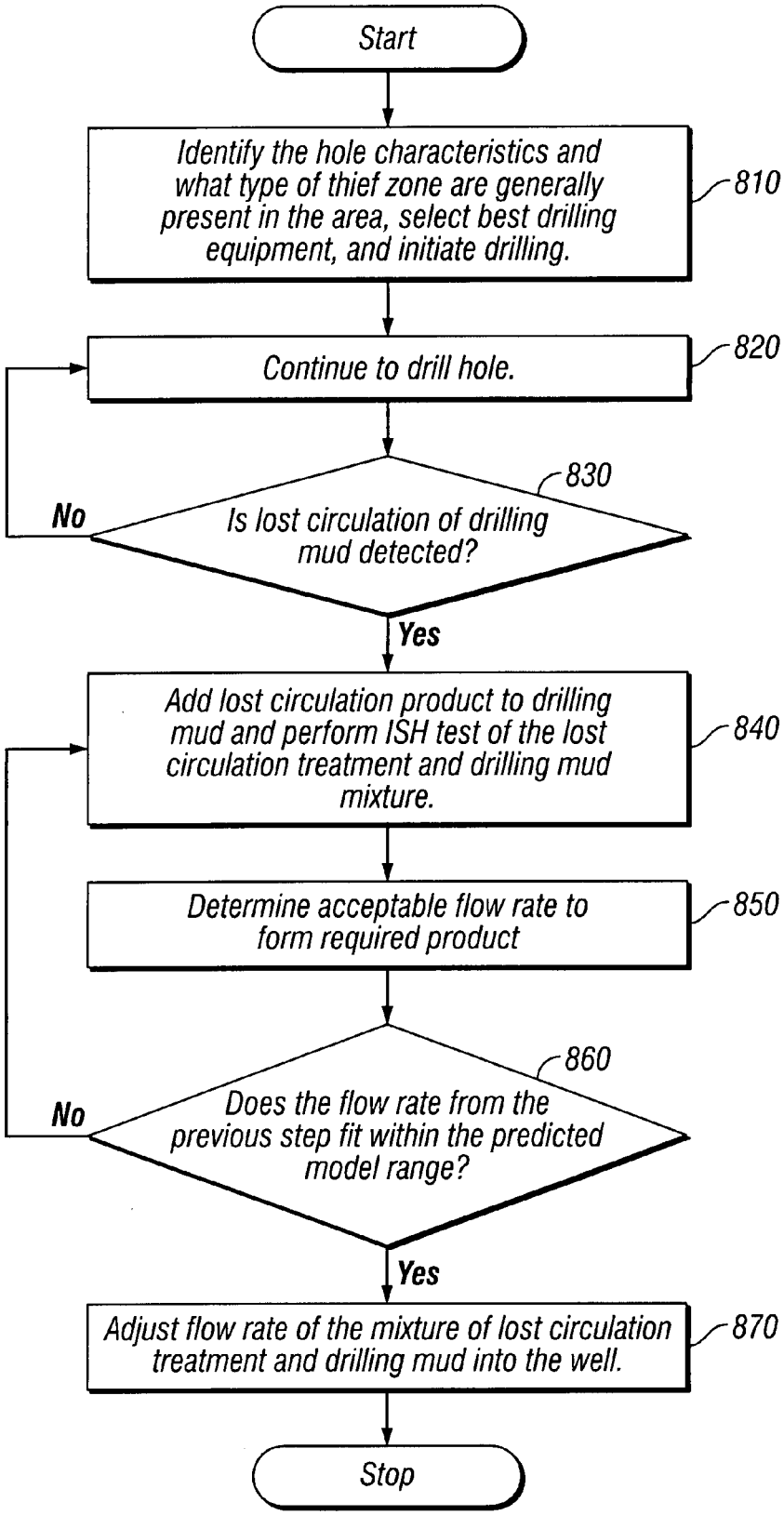
FIG. 8 shows a flowchart of another preferred embodiment.

FIG. 8 shows a flowchart of a preferred embodiment of one method of implementing the present inventions. First, the operator must identify the wellbore characteristics and what type of thief zone are generally present in the area and select the best drilling equipment (step 810). Drilling can then begin (step 820). If lost circulation is detected (step 830), the operator will need to add lost circulation product slurry(s) to wellbore fluids and perform ISH test of the lost circulation product slurry(s) and wellbore fluids mixture (step 840). Samples of wellbore fluids are taken and mixed at predetermined speeds and time to determine the shear rates and yield points (YP) under various conditions. These shear rates and YP are then used to determine the required PMN for an acceptable lost circulation product result to be formed. Using these results, the acceptable flow rate is determined (step 850) by determining the mixing energy required to obtain the PMN previously obtained. The operator then determines if the flow rate from the previous step fit within the predicted model range (step 860). If it does not fit, then retesting of ISH needs to be made. If the flow rate fits within the model range, the operator will add the lost circulation material to the wellbore fluids and adjust the flow rate of the mixture of lost circulation product slurry(s) and wellbore fluids into the well (step 870).

Figure 9:
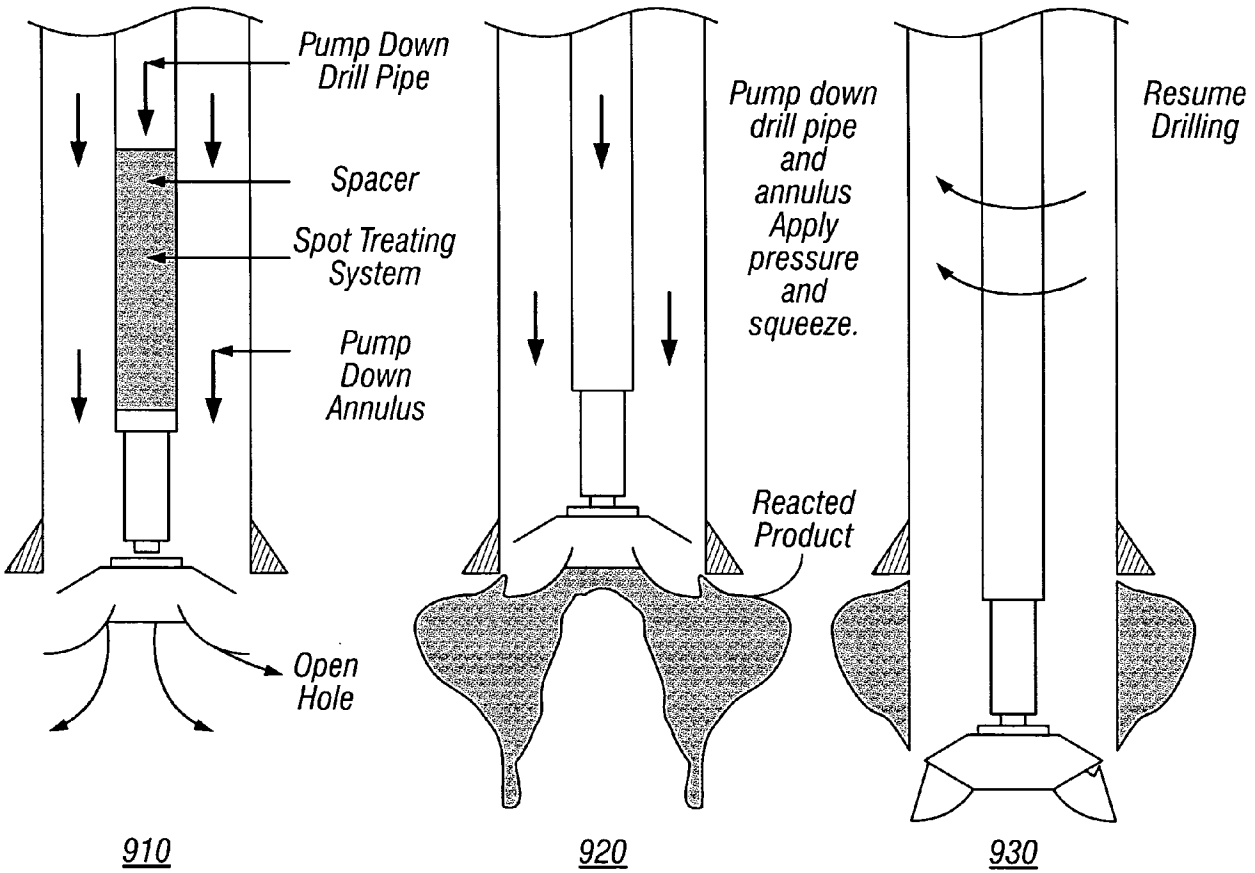
FIG. 9 is an illustration of the placement of the high-yielding non-Newtonian fluid product in a thief zone

FIG. 9 is an illustration of the overall process of the use of high-yielding non-Newtonian fluids in downhole conditions. First, the lost circulation of drilling mud (step 910) is detected. This detection is often the result of a measurable decrease in the drilling mud that is returning to the surface. After the thief zone is discovered, multiple fluid streams are pumped down the wellbore and converge at the desired location downhole to produce a high-yielding non-Newtonian viscous material that is then placed under pressure into the thief zone as shown in (step 920). Drilling can then resume as shown in (step 930).

Figure 10:
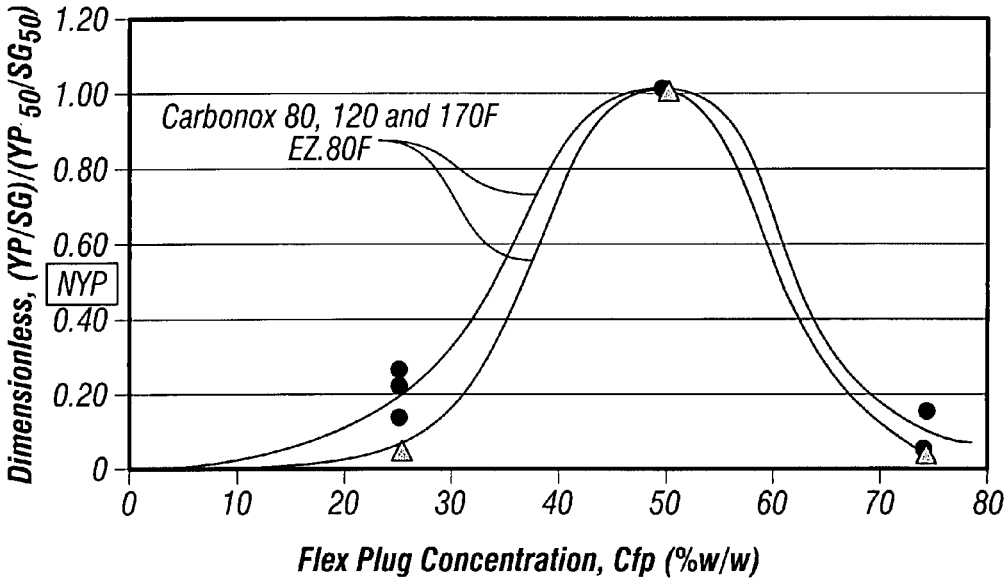
FIG. 10 is a plot of the yield point of the high-yielding non-Newtonian fluid measured against the concentration of the product slurry.

FIG. 10 is an example of empirical test results that show how the concentration of a lost circulation product, in this case FlexPlug®, affects the dimensionless yield point. In this example, product quality is plotted against various FlexPlug® and mud combinations. As this figure shows, a roughly 50/50 FlexPlug® mix produces the best quality under these tests. In some of the examples given herein, the percentage of mud and lost circulation treatment are presumed to be roughly 50/50.

Figure 11:
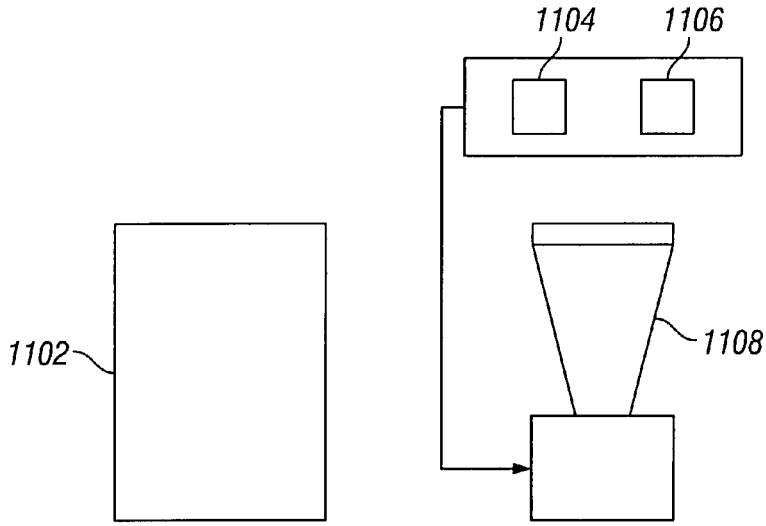
FIG. 11 is an illustration of the benchtop testing mechanism used to determine the ISH.

FIG. 11 is an example of the apparatus that can be used to determine the ISH. A manual yield point device 1102, rheostat 1104, time control mechanism 1106, and foam blender 1108 are shown. The mixture of wellbore fluids and lost circulation slurry(s) is added to the blender 1108. Then the speed of the mixing and time set by 1104 and 1106, respectively. After the blender has mixed the wellbore fluids and lost circulation product slurry(s), the manual yield point device 1102 takes the yield point.

Figure 12:
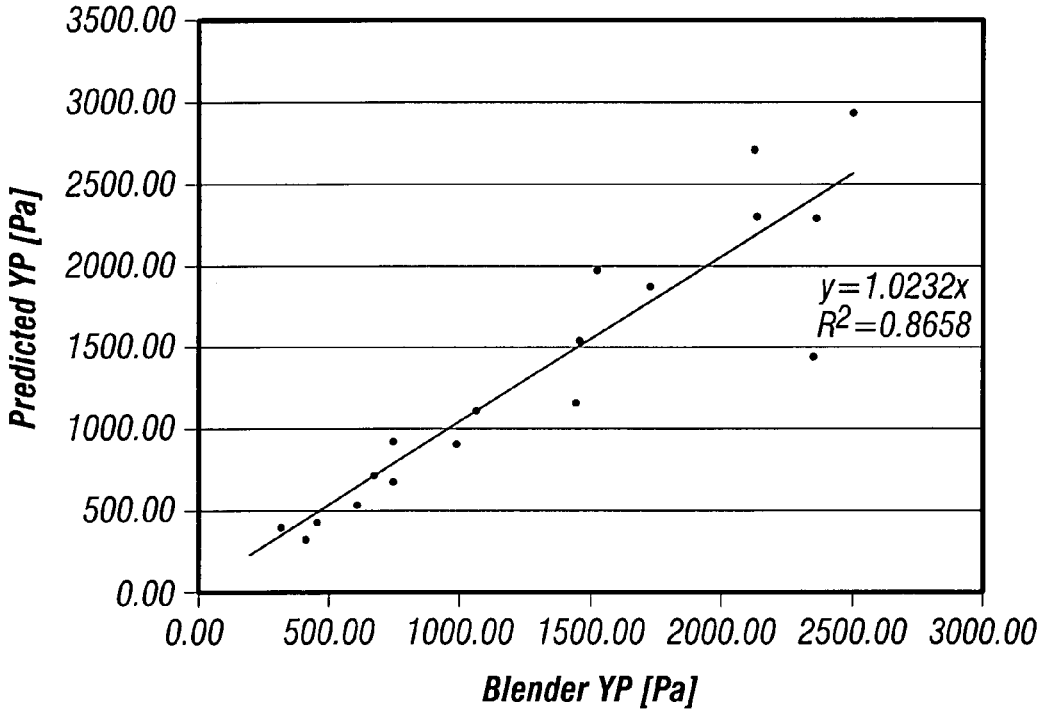
FIG. 12 is a chart of relationship between the yield point found by the bench top testing mechanism and the mathematically predicted yield point.

FIG. 12 is a chart of the validation results of the use of the blender produced yield point versus the mathematically predicted yield point. On the x-axis is the set of blender yield points, while on the y-axis is the predicted yield points from the mathematical model of the high-yielding non-Newtonian fluids. This validates the predicted yield point as $R^2$ is shown to be 0.8658.

Figure 13:
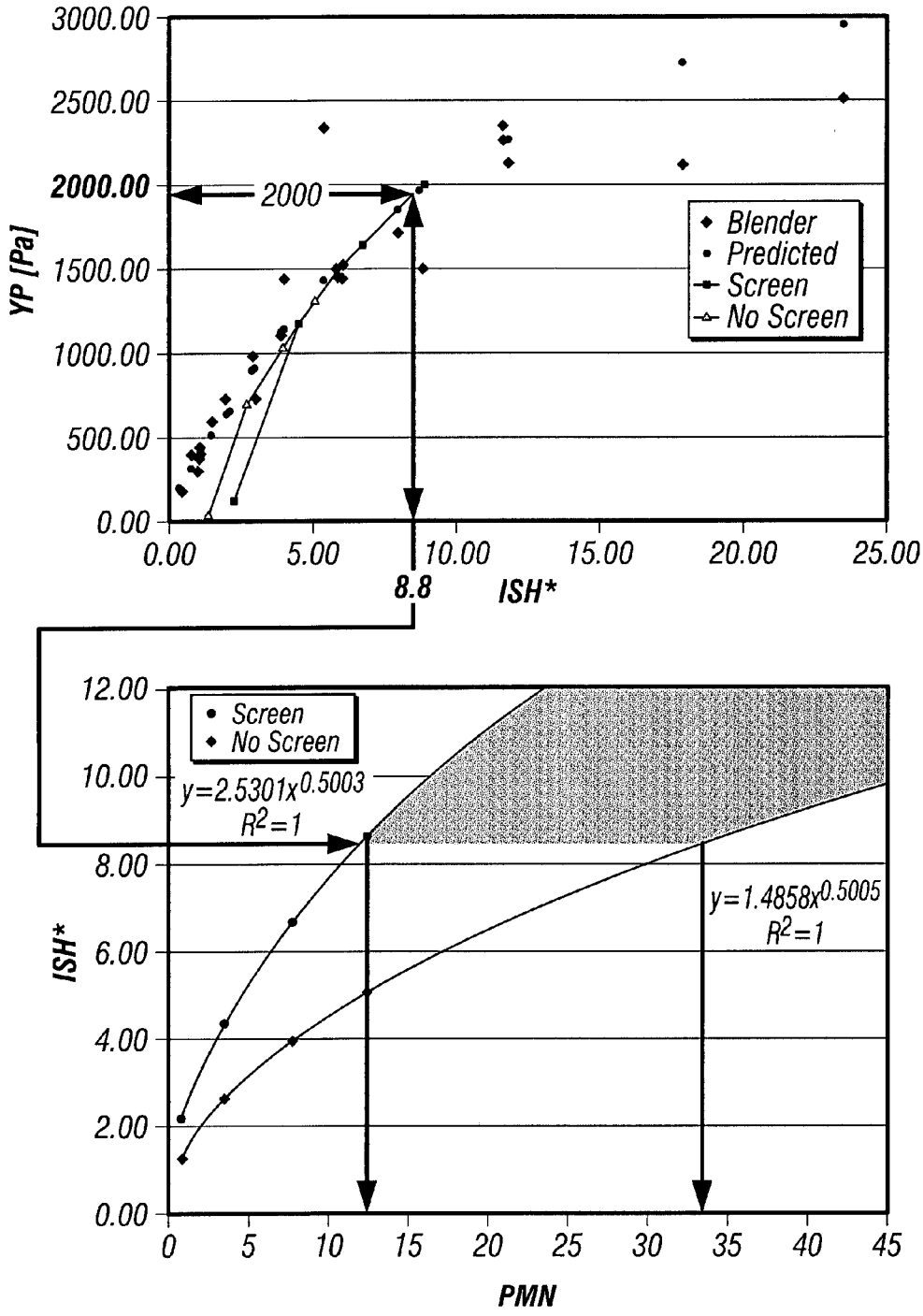
FIG. 13 is a set of two charts used to determine the proper PMN from the ISH.

FIG. 13 is an example of the correlation of the ISH and yield point to the ISH and the PMN. In this example, the point at which the ISH was determined to have created an acceptable product was at 8.8. This ISH can then be used in the ISH/PMN chart to determine which PMN is needed by certain equipment to form an acceptable product. This PMN outputs the flow rate required to achieve the product that is shown on the graph within the darkened region. Thus, with this information, a drill operator can determine the minimum flow rate for the lost circulation product and mid to ensure a product of acceptable viscosity.

One of the preferred embodiments relates to a method of treating a wellbore, comprising the steps of determining a mixing energy required for one or more products to reach a given viscosity through bench top testing, using a mathematical function, extrapolating data created by said testing to determine the mixing energy required for the one or more products to reach the given viscosity under a different range of physical parameters, and mixing said one or more reactants in a according to said mixing energy.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

The mathematic modeling system may use any number of mathematical software applications, including, but not limited to, mathematica, maple, or other commercial product. In addition, the number of dimensionless variables may vary from embodiment to embodiment.

A particular advantage of the present inventions is that they can be designed to accurately provide real-time correction of a mixing recipe to optimize downhole conditions.

Another particular advantage of the present invention is the correlation between the accumulated shear history and the yield point. This ISH can be used to obtain the PMN relates the lab mechanical mixing the fluid-to-fluid in-situ downhole mixing.

Another particular advantage of the present invention is that the mixing energy can optimize the placement of high-yielding non-Newtonian fluids onto any surface. These surfaces include cement, pipelines, or any other place where a non-Newtonian fluid could be used to stop fluid loss.

The inventors recognize that these surfaces may include walls, floors, or any other surface where it would be advantageous to have a viscous material form in order to stop or decrease the flow of a liquid from one area to another.

These applications include the use of the high yield non-Newtonian fluid to form a product in areas such as a formation used to dam one liquid in a confined area. In such an application, the high-yield non-Newtonian product would be applied in such a manner so that the force at which it is placed into an area would be calculated to achieve a predetermined yield point. This can be accomplished by using a single stream of fluid designed to mix with the material that was leaking from the dam in order to form a high-yield non-Newtonian product. This implementation of the present invention has the additional advantage of allowing the minimum energy to be applied to a dam, thus avoiding further damage to the dam, while ensuring that a high yield non-Newtonian product is formed of a sufficient yield point in order to close the fault in the dam.

The force at which the non-Newtonian fluid can be applied can be controlled by the rate at which the stream was pumped, the distance that it fell prior to being placed into the surface, the relative composition of the stream, or any other factor known in the art.

Another particular advantage of the present invention is the ability to close holes or cracks in pipe by using the viscous non-Newtonian product to fill in gaps located within the pipeline. A sample of the current material running through the pipeline can be analyzed to determine the best fluid that can be introduced into the pipeline to form the non-Newtonian product. The force at which the fluid would then be placed into the pipeline would be determined through the disclosed methodology. This implementation of the present invention has the additional advantages of allowing the minimum energy to be applied to an pipe, thus avoiding further damage to the pipe, while ensuring that a high yield non-Newtonian product is formed of a sufficient yield point in order to close the crack in the pipe.

Another implementation of the present invention would be to fill in small cracks in the base of any sealed container. For instance, if there is a liquid container, such as an oil container, with a leak, this methodology could be used to determine what the minimum mixing energy would be in order to apply a fluid to the oil drum to form the high yield non-Newtonian product. This implementation of the present invention has the additional advantages of allowing the minimum energy to be applied to an area, thus avoiding further damage to the container, while ensuring that a high yield non-Newtonian product is formed of a sufficient yield point in order to close the crack in the container.

Another advantage of the present invention is that it can be used to determine the yield point created by the mixing of fluids that form a high-yielding non-Newtonian product with any mixing energy introduced on any surface or in any area.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS.

What is claimed is:

1. A method of treating a wellbore, comprising the steps of:

determining an integral shear history required for one or more reactants to reach a given yield point through bench top testing;

using a similitude model of a wellbore to extrapolate data created by said bench top testing to determine shear input parameters in said wellbore required for said reactants to reach the determined integral shear history; and mixing said one or more reactants in accordance with said shear input parameters in said wellbore.

2. The method of claim 1, wherein one of said reactants is a lost circulation treatment material.

3. The method of claim 1, wherein said similitude model uses a dimensionless form of analysis.

4. The method of claim 3, further comprising the step of: choosing the mixture of said reactants to be used based on data obtained by said dimensionless analysis.

5. The method of claim 3, further comprising a step of using sensors to update said dimensionless analysis with actual downhole data.

6. The method of claim 3, wherein said dimensionless analysis comprises a pi mixing number.

7. The method of claim 1, wherein at least one of said reactants comprises:

oil present in an amount in the range of from about 32% to about 62% by weight of said composition;

a hydratable polymer present in an amount in the range of from about 3% to about 6% by weight of said composition;

an organophillic clay present in an amount in the range of from about 0.3% to about 0.6% by weight of said composition; and a water swellable clay present in an amount in the range of from about 34% to about 62% by weight of said composition.

8. The method of claim 1, wherein at least one of said reactants are delivered by two or more liquid streams, and where one or more streams are delivered through the drill-string.

9. The method of claim 1, further comprising the step of: choosing said reactants based upon the composition of wellbore fluids.

10. The method of claim 1, wherein said lost circulation treatment material is comprised of:

water present in an amount in the range of from about 6% to about 50% by weight of said composition;

an aqueous rubber latex present in an amount in the range of from about 33% to about 67% by weight of said composition;

an organophillic clay present in an amount in the range of from about 13% to about 22% by weight of said composition;

sodium carbonate present in an amount in the range of from about 2.7% to about 4.4% by weight of said composition; and a biopolymer present in an amount in the range of from about 0.1% to about 0.2% by weight of said composition.

11. The method of claim 1, wherein an acceptable viscosity is achieved downhole.

12. A method of mixing at least two materials, comprising the steps of:

performing at least one test in a first environment to estimate an integral shear history required to achieve an acceptable yield point for at least two materials; and translating said integral shear history a second environment to thereby estimate a shear input parameter of said second environment to thereby achieve said integral shear history.

13. The method of claim 12, wherein said integral shear history determined in at least one test is a minimum integral shear history required to obtain an acceptable yield point in said second environment.

14. The method of claim 12, wherein said integral shear history achieves a desired viscosity in said second environment.

15. The method of claim 12, wherein said shear input parameter is the velocity of a material through a passage.

16. The method of claim 12, wherein said shear input parameter is a jet velocity for flow-through a drill bit.

17. The method of claim 12, wherein said first environment is a mixing apparatus, and wherein the second cnvironment is a wellbore.

18. The method of claim 17, wherein the step of translating includes use of a similitude model of said wellbore.

19. The method of claim 18, wherein said translating step comprises using a pi mixing number.

20. A lost circulation prevention system comprising:

a wellbore;

at least one delivering component;

wellbore fluid;

lost circulation treatment material consisting of at least one fluid streams; and calculations that utilize dimensionless analysis to determine shear input parameters for said lost circulation treatment material and said wellbore fluid to create a lost circulation product;

wherein said lost circulation treatment material is introduced at the desired downhole location;

wherein said lost circulation treatment material mixes with one or more fluid streams to form a high-yielding non-Newtonian viscous material; and wherein the rate at which the lost circulation treatment material and said wellbore fluid are pumped is determined by said calculations;

wherein said calculations use a similitude model of said wellbore of downhole integral shear history as a function of flow rate of said lost circulation treatment material being pumped downhole into said wellbore.

21. The system of claim 20, wherein said delivering component is selected from the group consisting of: a drill string, a work string, and inner tubing, or various combinations thereof.

22. The system of claim 20, wherein said wellbore fluid is an oil based fluid.

23. The system of claim 20 wherein one fluid stream is used to deliver both the wellbore fluid and lost circulation treatment material.

24. The system of claim 20, wherein the pump rate is controlled by software from a remote location; wherein said software executes said calculations.

25. The system of claim 20, wherein said dimensionless analysis comprises a pi mixing number.

* * * * *